US005451055A

United States Patent [19]

Lo

[11] Patent Number: 5,451,055

[45] Date of Patent: Sep. 19, 1995

[54] TOWER PUZZLE TOY

[76] Inventor: Wei W. Lo, No. 14, Lane 177, Guang-Fu N Rd., Taipei, Taiwan

[21] Appl. No.: 292,650

[22] Filed: Aug. 18, 1994

[51] Int. Cl.[6] ..... A63F 9/06

[52] U.S. Cl. ..... 273/153 S; 273/113

[58] Field of Search ..... 273/153 S, 155, 153 R, 273/110, 113, 115, 118 R, 123 R

[56] References Cited

U.S. PATENT DOCUMENTS

| | | | |
|---|---|---|---|
| 3,747,937 | 7/1973 | Fabricani | 273/113 |
| 4,008,895 | 2/1977 | Reiner et al. | 273/113 |
| 4,376,537 | 3/1983 | Yokoi | 273/113 |
| 4,413,823 | 11/1983 | Breslow | 273/153 S |
| 4,509,753 | 4/1985 | Vaughan, Jr. | 273/110 |
| 4,754,972 | 7/1988 | Boskovic | 273/153 S |
| 4,822,049 | 4/1989 | Biber | 273/110 |
| 5,123,650 | 6/1992 | Slauter | 273/155 |
| 5,292,126 | 3/1994 | Hanley | 273/113 |

*Primary Examiner*—V. Millin
*Assistant Examiner*—Steven B. Wong
*Attorney, Agent, or Firm*—Pro-Techtor International

[57] ABSTRACT

A tower puzzle toy including a central shaft, a top cap and a bottom cap respectively fastened to the central shaft at two opposite ends, a plurality of rotary decks revolvably mounted around the central shaft and defining a plurality of radial ball chambers, a top packing ring and a bottom packing ring respectively mounted around the central shaft and retained between the central shaft and either cap, and at least one ball for insertion through a ball inlet on either cap through a through hole on either packing ring into either ball chamber, wherein the at least one ball is moved from one ball chamber to another and from one rotary deck to another by turning the rotary decks around the central shaft relative to one another and/or turning the tower puzzle toy upside down.

7 Claims, 8 Drawing Sheets

TOWER PUZZLE TOY

BACKGROUND OF THE INVENTION

The present invention relates to a tower puzzle toy which can be used for playing the game of three-dimensional picture puzzle as well as the game of gobang.

Various puzzle toys have been disclosed, and have appeared on the market. FIG. 1 shows a tower puzzle toy comprised of a plurality of rotary decks 10 and a plurality of balls 11 of different colors moved between holes on the rotary decks. The balls 11 can be shifted one another by turning the rotary decks 10 relative to one another. This structure of tower puzzle toy is suitable for one player only. Furthermore, this structure of tower puzzle toy is less intricate, and the player cannot set by oneself a network of complicated, three-dimensional winding paths as desired.

SUMMARY OF THE INVENTION

The present invention has been accomplished to provide a tower puzzle toy which is suitable for one player as well as two players and, which allows the player to set up a network of complicated, three-dimensional winding paths for passing a ball as desired.

According to one aspect of the present invention, the tower puzzle toy comprises a central shaft, a top cap and a bottom cap respectively fastened to the central shaft at two opposite ends, a plurality of rotary decks revolvably mounted around the central shaft and defining a plurality of radial ball chambers, a top packing ring and a bottom packing ring respectively mounted around the central shaft and retained between the central shaft and either cap, and at least one ball for insertion through a ball inlet on either cap through a through hole on either packing ring into either ball chamber, wherein the at least one ball is moved from one ball chamber to another and from one rotary deck to another by turning the rotary decks around the central shaft relative to one another and/or turning the tower puzzle toy upside down.

According to another aspect of the present invention, different insertion plates are provided for insertion into either ball chamber to change the moving route of the at least one ball so that the player can change the network of complicated, three-dimensional winding paths for passing the at least one ball.

DETAILED DESCRIPTION OF THE PREFERRED EMBODIMENT

Figure 1:
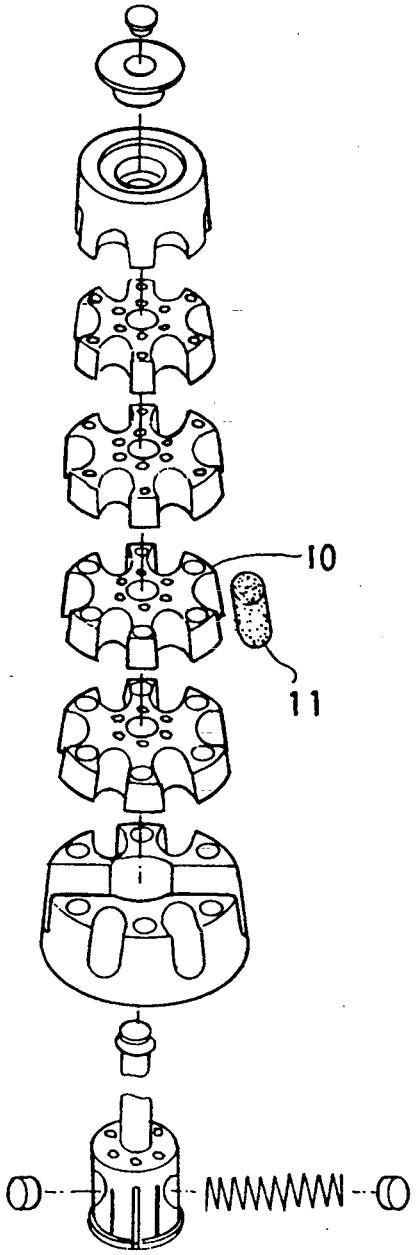
FIG.1 (PRIOR ART)
FIG. 1 is an exploded view of a tower puzzle toy according to the prior art.
Figure 2:
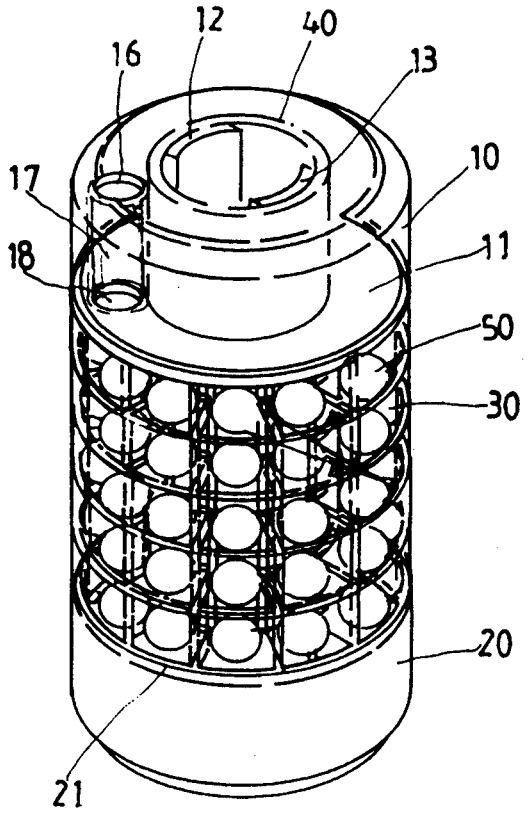
FIG. 2 is a perspective view of a tower puzzle toy according to the present invention.
Figure 3:
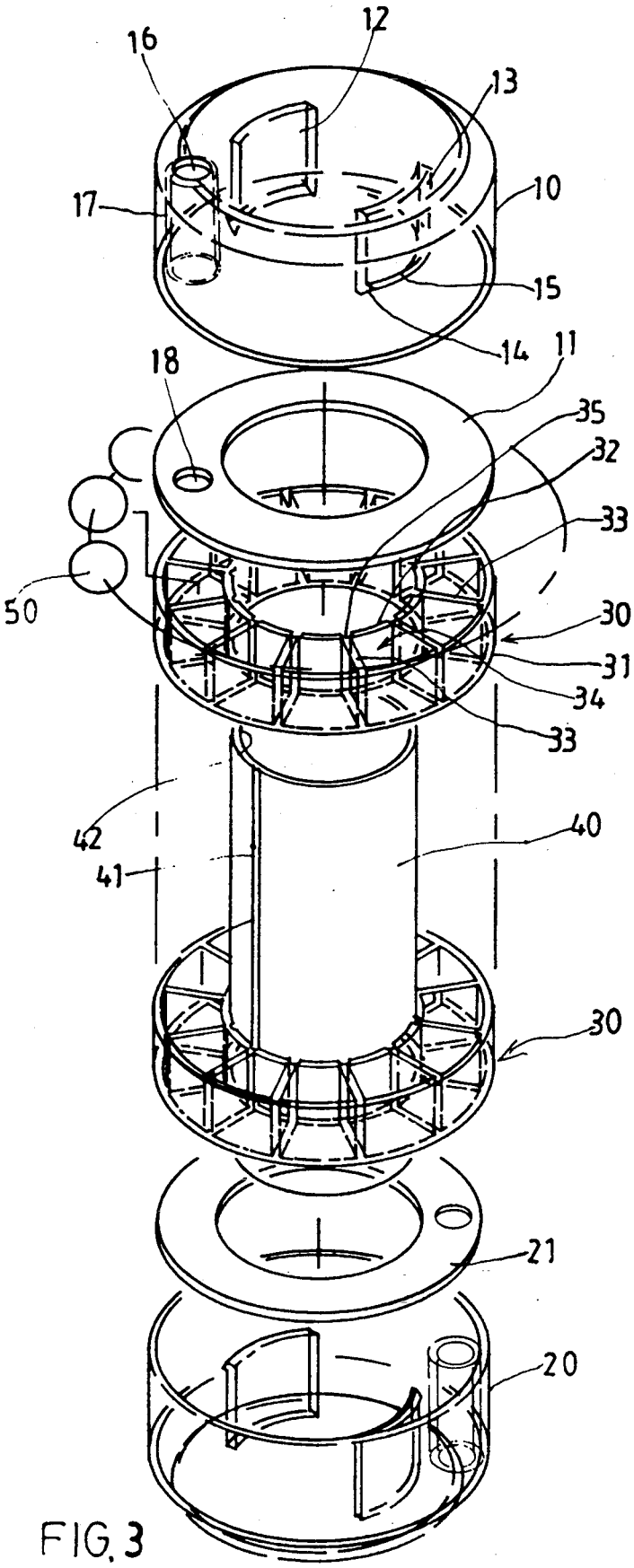
FIG. 3 is an exploded view of the tower puzzle toy shown in FIG. 2.

Referring to FIGS. 2 and 3, a tower puzzle toy in accordance with the present invention is generally comprised of a top cap 10, a bottom cap 20, a top packing ring 11, a bottom packing ring 21, a plurality of rotary decks 30, a central shaft 40, and a plurality of balls 50. The top and bottom caps 10 and 20 are identical and symmetrically disposed at two opposite ends. The top and bottom packing rings 11 and 21 are identical and respectively attached to the caps 10 and 20 at an inner side. Preferably, the top and bottom caps 10 and 20 are molded from transparent plastics.

As illustrated, the cap 10 or 20 comprises two curved, downward plates 12 and 13 symmetrically disposed on the inside, a vertical inlet 16 near the border, a downward extension tube 17 extended from the vertical inlet 16. The packing ring 11 or 21 has a through hole 18 aligned with the bore of the downward extension tube 17 and the vertical inlet 16. The downward plate 12 or 13 has a bevel bottom edge 14 and a locating flange 15 horizontally spaced above the bevel bottom edge 14.

The rotary decks 30 are preferably molded from transparent plastics, each comprising an outer race 31, an inner race 32, and a plurality of partition boards 33 radially spaced between the outer race 31 and the inner race 32 and defining a plurality of ball chambers 34. The inner race 32 has a plurality of vertical grooves 35 corresponding to the partition boards 33. According to this embodiment, the ball chambers 34 are of open chambers having each the top and bottom sides opened. The distance between the outer race 31 and the inner race 32 is approximately equal to the radial width of the packing rings 11 and 21.

The central shaft 40 is a hollow shaft (which may be formed by fastening two symmetrical half-round shells together, comprising a longitudinal rib 41 on the outside. When the rotary decks 30 are mounted around the central shaft 40, the rib 41 engages a vertical groove 35 on the inner race 32 of each rotary deck 30.

Figure 4:
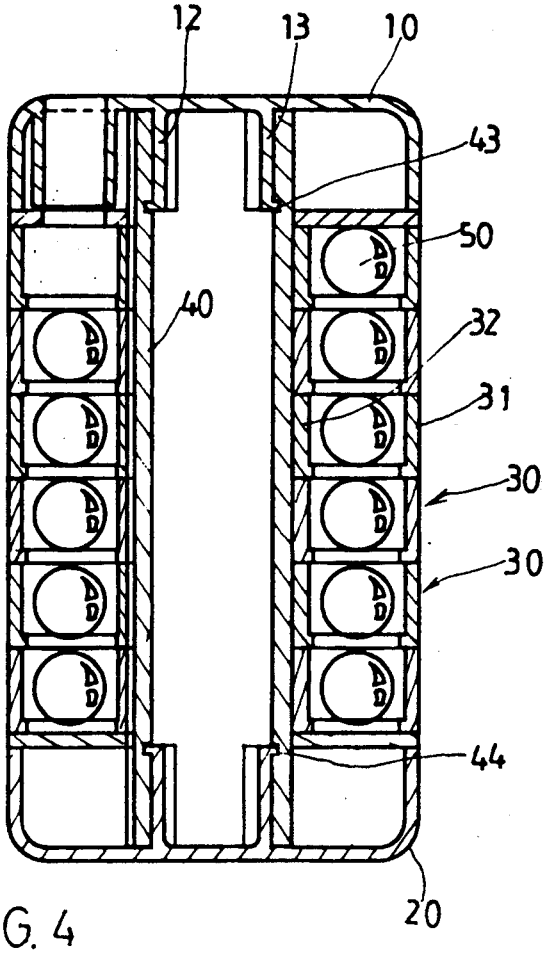
FIG. 4 is a longitudinal view in section of the tower puzzle toy shown in FIG. 2.
Figure 5:
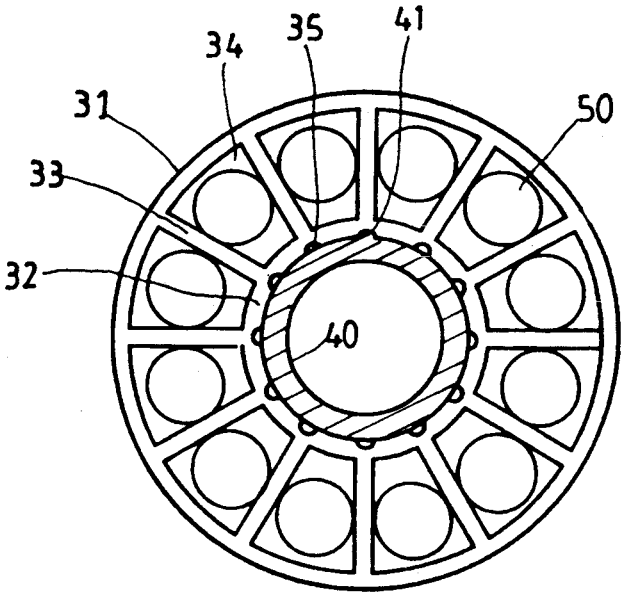
FIG. 5 is a top view in section of the tower puzzle toy shown in FIG. 2.

Referring to FIG. 4, the central shaft 40 has two annular grooves 43 and 44 spaced around the longitudinal center through hole 42 thereof near two opposite ends. After the rotary decks 30 have been mounted around the central shaft 40, the top and bottom caps 10 and 20 are respectively fastened to the two opposite ends of the central shaft 40 by fitting the downward plates 12 and 13 into longitudinal center through hole 42 permitting the locating flanges 15 of the downward plates 12 and 13 of the top and bottom caps 10 and 20 to engage the inside annular grooves 43 and 44 respectively. Because the downward plates 12 and 13 have a respective bevel bottom edge 14, they can be conveniently inserted into the longitudinal center through hole 42 of the central shaft 40. When assembled, the balls 50 are respectively received in each ball chamber 34 of each rotary deck 30 with only one ball chamber 34 left vacant. The balls 50 may be made in different colors or marked with different patterns. By turning the rotary decks 30 relative to one another, the balls 50 can be shifted from one ball chamber 34 to another to change the combination of the colors or patterns of the balls 50. The tower puzzle toy may be played with two players alternating and attempting to be first to place four or five balls 50 in a row. Because the balls 50 can be inserted into the tower puzzle toy from either end, the tower puzzle toy can be turned upside down during the playing. Therefore, the players must think about all three dimensional positions through 360° angle. Furthermore, when all the balls 50 have been put in the tower puzzle toy, the vertical inlet 16 on each cap 10 and 20 may be sealed by a detachable cover (not shown).

Figure 6:
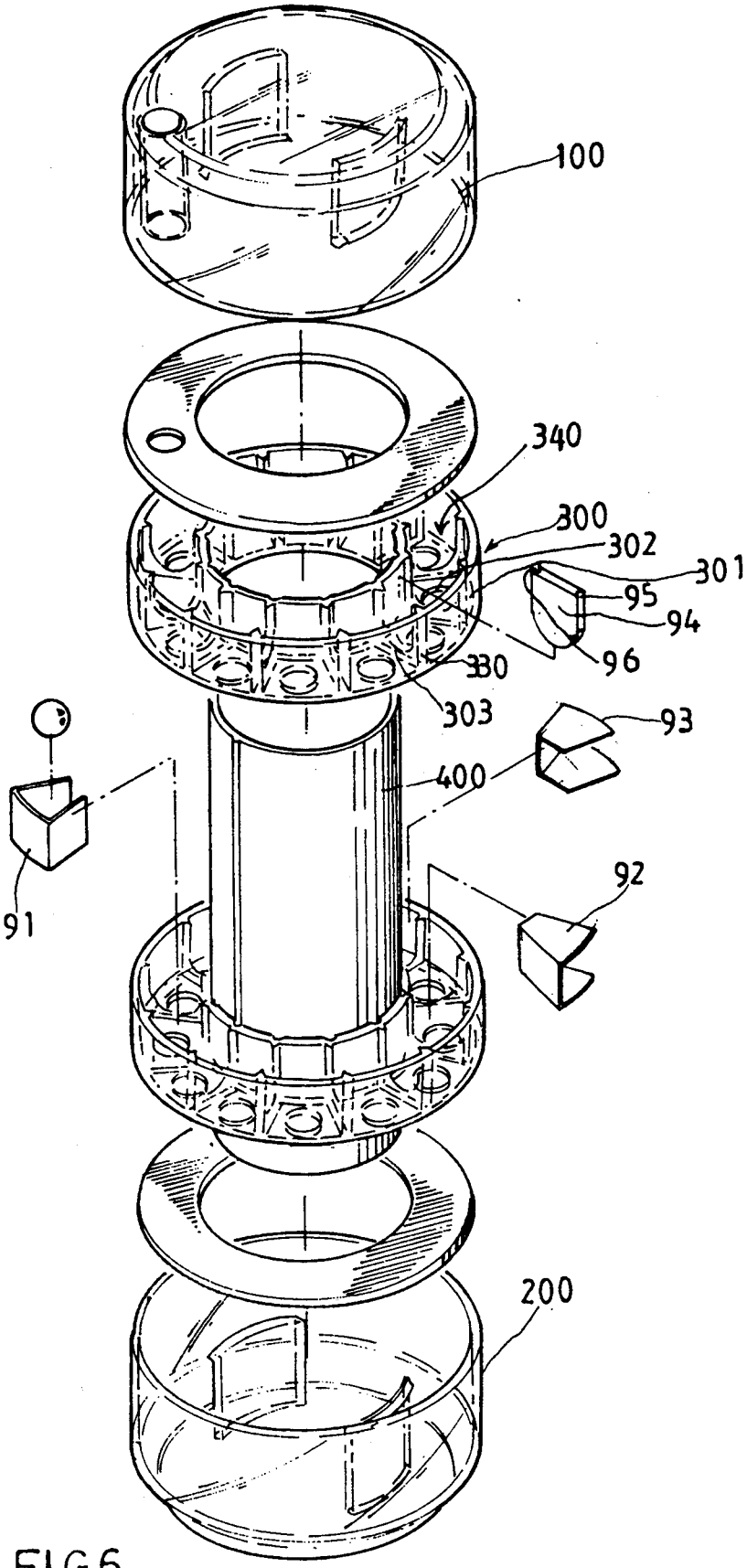
FIG. 6 is an exploded view of an alternate form of the tower puzzle toy of the present invention.
Figure 7:
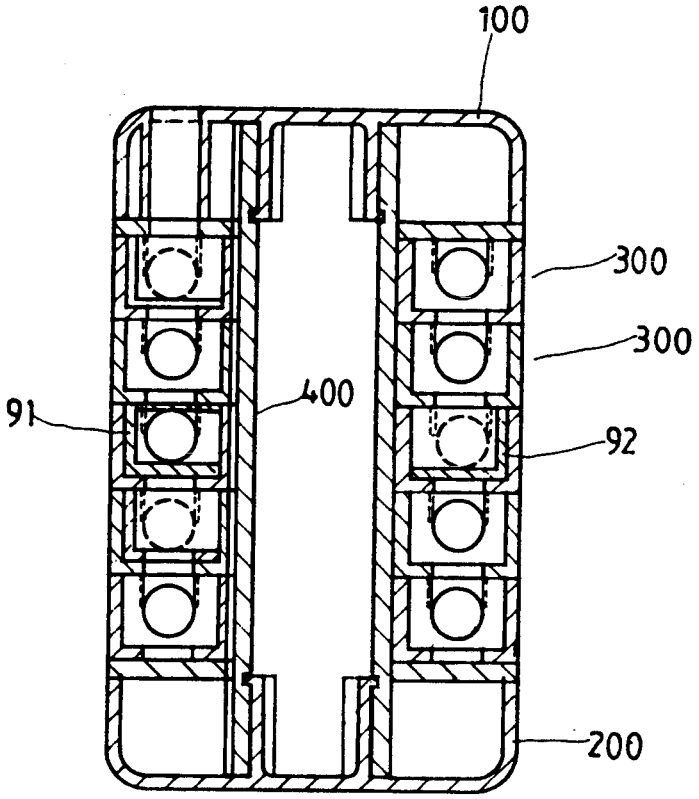
FIG. 7 is a longitudinal view in section of the alternate form of FIG. 6.
Figure 8:
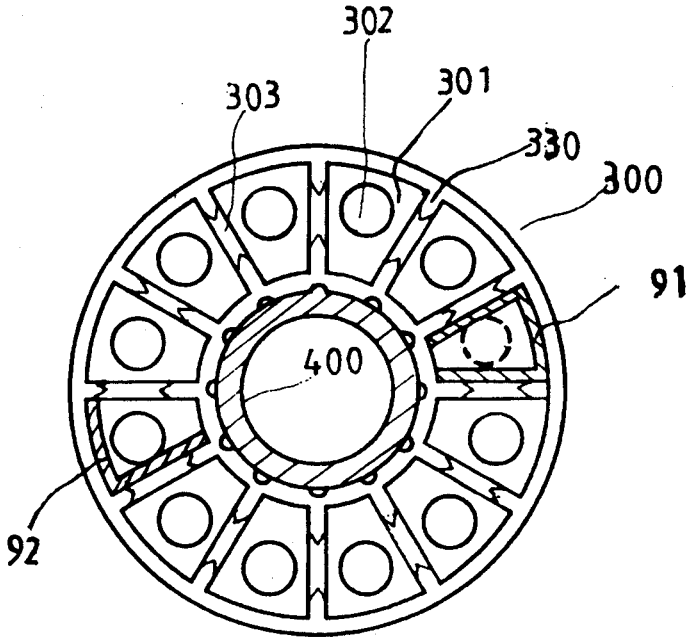
FIG. 8 is a top view in section of the alternate form of FIG. 6.

FIGS. 6, 7, and 8 illustrate an alternate form of the present invention. This alternate form is also comprised of a central shaft 400, a top cap 100, a bottom cap 200, a top packing ring 110, a bottom packing ring 210, and a plurality of rotary decks 300. The central shaft 400, top cap 100, bottom cap 200, top packing ring 110 and bottom packing ring 210 are similar to like parts in the embodiment shown in FIGS. 2 through 5. The rotary deck 300 comprises a closed bottom 301, a plurality of ball chambers 340 radially disposed around a circle and separated from one another by a plurality of radial partition boards 330, a plurality of circular through holes 302 respectively disposed in each ball chamber 340 through the closed bottom 301, wherein each radial partition board 330 defines a U-shaped passage 303.

Referring to FIG. 6 again, different insertion plates 91, 92, 93, 94, etc. may be used to block the ball chambers 340 in different directions. The first insertion plate 91 blocks up the bottom and two lateral sides of the respective ball chamber 340 with the top side open for letting a ball in. The second insertion plate 92 blocks up the top and bottom sides as well as the left side of the respective ball chamber 340 with the right side open for letting a ball in. The third insertion plate 93 blocks up the top and bottom sides as well as the right side of the respective ball chamber 340 with the left side open for letting a ball in. The fourth insertion plate 94 is a flat plate having two opposite sliding grooves 95 and 96 for mounting on either radial partition board 330 to block up the respective U-shaped passage 303. Alternatively, the fourth insertion plate 94 may be made of circular shape for blocking up the circular through hole 302 on either ball chamber 340.

Referring to FIGS. 7 and 8 again, by inserting different insertion plates 91, 92, 93 and 94 in the ball chambers 340, a network of complicated, three-dimensional winding paths is set, and the player can find the way from the inlet on the top cap 100 to the inlet on the bottom cap 200 by turning the rotary decks 300.

While only few embodiments of the present invention have been shown and described, it will be understood that various modifications and changes could be made without departing from the spirit and scope of the invention.

What is claimed is:

1. A tower puzzle toy comprising:

a central shaft, a top cap and a bottom cap respectively fastened to said central shaft at two opposing ends, a plurality of rotary decks revolvably mounted around said central shaft, a top packing ring mounted around said central shaft and retained between said top cap and said rotary decks, a bottom packing ring mounted around said central shaft and retained between said bottom cap and said rotary decks, each rotary deck comprising an inner race, an outer race, a plurality of ball chambers spaced form one another around said inner race by a plurality of partition boards being radially connected between said inner race and said outer race, said top and bottom cap each having a ball inlet, said top and bottom packing rings each having a through hole aligned with one of the ball inlets, and at least one ball, wherein said ball is inserted into one of the ball inlets and moved into any of the ball chambers in the rotary decks by turning said rotary decks relative to one another around said central shaft, and wherein said central shaft has a longitudinal central through hole and two inside annular grooves around said longitudinal central through hole at two opposite ends; said top and bottom cap each have a plurality of curved plates fitted into an end of the longitudinal central through hole of said central shaft, each curved plate having a locating flange engaged with one of the inside annular grooves of said central shaft.

2. A tower puzzle toy comprising:

a central shaft, a top cap and a bottom cap respectively fastened to said central shaft at two opposing ends, a plurality of rotary decks revolvably mounted around said central shaft, a top packing ring mounted around said central shaft and retained between said top cap and said rotary decks, a bottom packing ring mounted around said central shaft and retained between said bottom cap and said rotary decks, each rotary deck comprising an inner race, an outer race, a plurality of ball chambers spaced from one another around said inner race by a plurality of partition boards being radially connected between said inner race and said outer race, said top and bottom cap each having a ball inlet, said top and bottom packing rings each having a through hole aligned with one of the ball inlets, and at least one ball, wherein said ball is inserted into one of the ball inlets and moved into any of the ball chambers in the rotary decks by turning said rotary decks relative to one another around said central shaft, and wherein the partition boards of each rotary deck have a passage through which said ball can be moved between adjacent ball chambers; each ball chamber of each rotary deck has an open top and a closed bottom, the closed bottom of each ball chamber having a through hole through which said ball can be moved between adjacent rotary decks.

3. The tower puzzle toy of claim 2 further comprising a plurality of insertion plates for insertion into either ball chamber to block up either one or two or three sides to change the passage route through said rotary decks for said at least one ball.

4. The tower puzzle toy of claim 3 wherein said insertion plates include at least one insertion plate for blocking up either ball chamber with a top side open for letting one of said at least one ball in.

5. The tower puzzle toy of claim 3 wherein said insertion plates include at least one insertion plate for blocking up either ball chamber with a left side open for letting one of said at least one ball in.

6. The tower puzzle toy of claim 3 wherein said insertion plates include at least one insertion plate for blocking up the passage on either partition board.

7. The tower puzzle toy of claim 3 wherein said insertion plates include at least one insertion plate for blocking up the through hole on the close bottom of either ball chamber.

* * * * *